US006497064B1

(12) United States Patent
Keaton

(10) Patent No.: US 6,497,064 B1
(45) Date of Patent: Dec. 24, 2002

(54) SHOULDER-END ATTACHMENT SYSTEM FOR FIREARMS

(76) Inventor: Don Keaton, Box 625, Lebanon, TN (US) 37088

( * ) Notice: Subject to any disclaimer, the term of this patent is extended or adjusted under 35 U.S.C. 154(b) by 0 days.

(21) Appl. No.: 09/467,349

(22) Filed: Dec. 20, 1999

Related U.S. Application Data

(60) Provisional application No. 60/113,105, filed on Dec. 21, 1998.

(51) Int. Cl.[7] ..... F41C 23/00
(52) U.S. Cl. ..... 42/74; 42/73; 42/71.01
(58) Field of Search ..... 42/71.01, 73–74

(56) References Cited

U.S. PATENT DOCUMENTS 2,925,679 A * 2/1960 Bivens ..... 42/74
4,887,374 A * 12/1989 Santarossa ..... 42/73
5,068,991 A * 12/1991 Reed ..... 42/71.01
5,519,957 A * 5/1996 Iannetta ..... 42/74
6,032,397 A * 3/2000 Iannetta ..... 42/73

* cited by examiner

*Primary Examiner*—Charles T. Jordan
*Assistant Examiner*—Lulit Semunegus
(74) *Attorney, Agent, or Firm*—Baker Botts L.L.P.

(57) ABSTRACT

The butt stock of a firearm and the butt stock assembly are held together magnetically, such that it requires and adult level of grip to separate them. This provides a strong and dependable butt pad, with the ability to change the length of the pull on a gun stock, in seconds. It provides a storage area in the butt stock of the firearm, that is easy opened, without the use of any hand tools.

20 Claims, 2 Drawing Sheets

SHOULDER-END ATTACHMENT SYSTEM FOR FIREARMS

This application claims benefit of Provisional Application 60/113,105 filed Dec. 21, 1998.

1. Field of the Invention

This invention relates to shoulder firearms, specifically to butt stocks.

2. Description of Prior Art

In conventional shotgun and rifles, the butt plate requires a screw driver to remove the butt plate or recoil pad. The need for a quick change butt plate has not been meet. there are systems that require tools to change or gain excess to the butt of the gun. These systems require the fitting of some type of male and female fitting device, that requires a very exact fit to work. Specifically, in U.S. Pat. No. 5068991 to Reed, a male and female piece of metal that requires a release system which has moving parts. This system requires two large exposed pieces of metal to work, that if they become dirty they will fail to work. The U.S. Pat. No. 4055016 to Katsenes a modifiale gun stock this is a complex system. The butt member being releasably secured to the stock member by anchor means comprising relatively rotatable plug and receptable means with a cam helix biasing a spring to forwardly couple the butt member into keyed engagement with the stock member to overlie and capture the comb member in its secured position The configurable sniper rifle stock U.S. Pat. No. 05711102 to Choate is another butt plate that is held in place by screws and requires tools to make adjustments to the length of the stock. The majority of the mentioned systems and U.S. Pat. No. 4887374 to Santarossa change the appearance of the firearm and require metal plates to be fitted to the butt of the firearm, most of which are very unattractive to a expensive firearm. To keep the same length of pull with the owners butt stock, the stock must be cut off and this effects the value of the firearm greatly.

Summary Of The Invention

Therefore the objects of the invention include: providing a cheap and easy method for changing the butt plate on a firearm, providing a means for more than one person to use the same gun in a shooting contest, providing a storage area for keys, matches and extra ammo, providing the average shooter of muzzle loading guns a place to carry the items they need for shooting.

Today more of the firearms being made have hollow stocks and this would be a natural area for the shooter to use.

Other, more particular objects and features of the invention will be in part recognized by those skilled in the art and will in part appear from the following description of the preferred embodiments and the claims, taken together with the drawings.

Figure 1A:
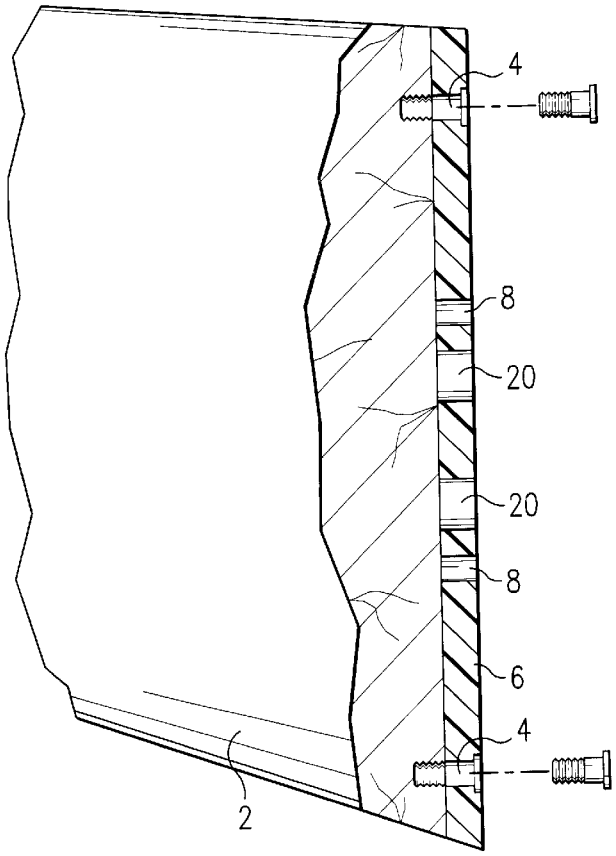
FIG. 1A shows a butt portion of a firearm with a spacer attached by two screws.

The drawings are not to any particular scale.

REFERENCE NUMERIALS IN DRAWINGS

2 gun stock
4 screw holes that holds butt plate on
6 spacer that may be used on butt stock
8 hole for pins for alignment
10 pins for alignment
12 spacer for butt plate or recoil pad
14 butt plate or recoil pad
16 screw holes
18 metal plate for butt plate or recoil pad
20 magnets

Description Of The Preferred Embodiment

Figure 1B:
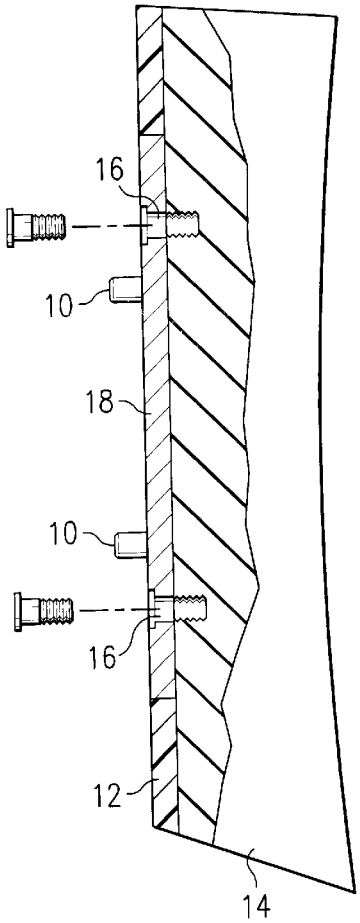
FIG. 1B shows the butt plate or recoil pad of the firearm.
Figure 2A:
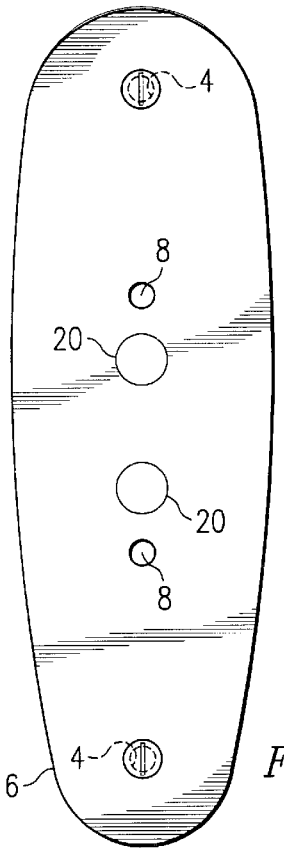
FIG. 2A shows a end view of the butt stock with a spacer attached.
Figure 2B:
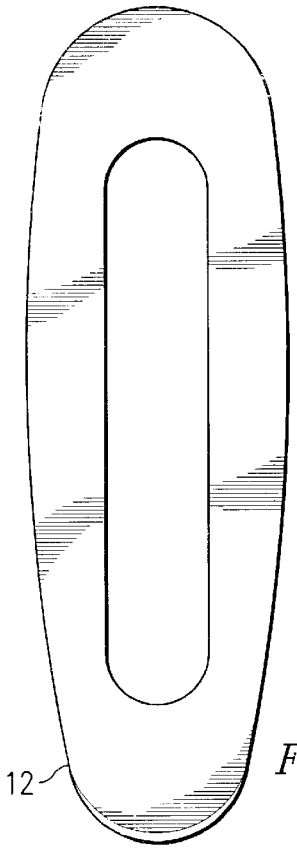
FIG. 2B shows a flat view of a spacer that can be used on the butt plate or recoil pad.
Figure 3A:
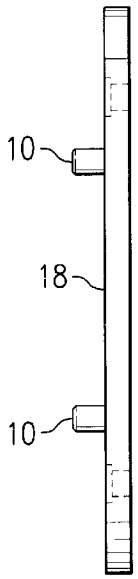
FIGS. 3A-B shows a side and flat view of a metal plate that can attached to the butt plate or recoil pad.
Figure 3B:
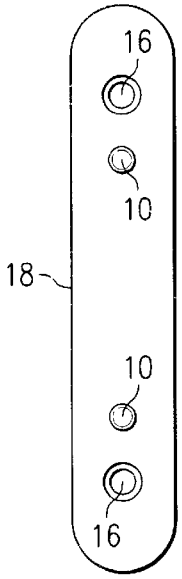

The main improvement in using the magnet system is there are many alternative ways to obtain the same results. The gun stock 2 can have a spacer 6 attached by two screws. If the stock is hollow the butt plate FIG. 1B can fit inside the stock for alignment and the spacer is not needed. This system permits the shooter to inlet or attach with two screws 18 a metal plate to butt plate or recoil pad. This metal plate maybe exposed or under rubber, plastic or other material. There are 20 two magnets. that may be mounted in the butt stock 6 spacer or in the stock directly. The other patents that use metal plates do not use a magnet system to retain the butt plate, and the metal plates must be exposed and fit together to work. If a spacer is attached to the butt stock FIG. 1A it will use two holes 8 for the pins 10 to align the butt plate. When the spacer on the butt stock is used it is attached by two screws 4. The metal plate 18 is held in place with two screws 16 through the butt plate, or pad.

From the description above, a number of advantages of the present invention become evident:

(a) it provides a wide range of options for the shooter in how to install the magnet system, and make it fit has shooting needs. The spacers may be used or omitted .

(b) if the spacers are used to average shooter can install it himself.

(c) if the system is removed , then the firearm is not damaged or changed in appearance and retains its value.

(d) no tools are needed to change the butt plate

Summary, Ramifications, and Scope

The terms and expressions used in this specification are used as terms of description and not of limitations and there is no intent in the use of such terms and expressions to exclude and equivalent of the features shown in the prescribed proportions thereof but it is recognized that various modifications are possible within the scope of the invention claim. Accordingly, it is seen that the magnetic system has the advantage over attaching large metal plates, and cutting off the gun stocks. The male and female fitting systems must be free of dirt and rust at all times, the metal in the magnetic system can be covered from the elements and be different sizes and shapes and still work.

In the past the NEODYMIUM, type magnet was not readily availability and cost effective for this type of use. This type of magnet allows reduced size and weight to magnet assemblies with four to six times the energy of the strong ALNICO 5, type magnet.

Thus the scope of the invention should be determined by the appended claims and their legal equivalents rather than by the examples given.

I claim:

1. A shoulder-end attachment system for a firearm, comprising:

a spacer sized to occupy at least a significant portion of a butt end of a firearm stock, the spacer comprising:

a first surface adapted for mounting to a butt end of a firearm stock, a second surface opposite the first surface, and at least one magnet;

a plate sized to occupy at least a significant portion of a butt end of a firearm stock, the plate comprising;

a first surface adapted for mounting to a shoulder-end of a firearm, a second surface opposite the first surface, and a magnetically attractable material;

wherein the plate is magnetically attracted to the spacer when mated.

2. The system of claim 1, wherein the spacer comprises a recess approximately the same size as the plate, the plate fitting within the recess when the plate is mated with the spacer.

3. The system of claim 2, wherein the first surface of the plate is substantially flush with the outside of the spacer when the plate is mated with the spacer.

4. The system of claim 1, wherein the plate comprises a spacer section approximately the same size as the second surface of the spacer and having an aperture approximately the same size as the second surface of the plate.

5. The system of claim 4, wherein the spacer section is substantially flush with the second surface of the spacer when the plate is mated with the spacer.

6. The system of claim 1, wherein:

the plate comprises a plurality of pins that protrude from the second surface; and the spacer comprises a plurality of apertures to receive the pins.

7. The system of claim 1, wherein the spacer comprises a plurality of apertures from the first surface to the second surface, the apertures for receiving screws to attach the spacer to a firearm stock.

8. The system of claim 7, wherein the apertures are spaced to align with apertures in a standard firearm stock.

9. The system of Claim 1, wherein the magnet comprises a Neodymium magnet.

10. The system of claim 1, wherein the first surface of the plate is adapted for mounting to a butt plate of a firearm.

11. A shoulder-end attachment system for a firearm, comprising:

a plate sized to occupy at least a significant portion of a butt end of a firearm stock, the plate comprising:

a first surface adapted for mounting to a butt end of a firearm stock, a second surface opposite the first surface, and a magnetically attractable material;

a spacer sized to occupy at least a significant portion of a butt end of a firearm stock, the spacer comprising:

a first surface adapted for mounting to a shoulder-end of a firearm, a second surface opposite the first surface, and at least one magnet;

wherein the plate is magnetically attracted to the spacer when mated.

12. The system of claim 11, wherein the spacer comprises a recess approximately the same size as the plate, the plate fitting within the recess when the spacer is mated with the plate.

13. The system of claim 12, wherein the first surface of the plate is substantially flush with the outside of the spacer when the spacer is mated with the plate.

14. The system of claim 11, wherein the plate comprises a spacer section approximately the same size as the second surface of the spacer and having an aperture approximately the same size as the second surface of the plate.

15. The system of claim 14, wherein the spacer section is substantially flush with the second surface of the spacer when the plate is mated with the spacer.

16. The system of claim 11, wherein:

the plate comprises a plurality of pins that protrude from the second surface; and the spacer comprises a plurality of apertures to receive the pins.

17. The system of claim 11, wherein the plate comprises a plurality of apertures from the first surface to the second surface, the apertures for receiving screws to attach the plate to a firearm stock.

18. The system of claim 17, wherein the apertures are spaced to align with apertures in a standard firearm stock.

19. The system of claim 11, wherein the magnet comprises a Neodymium magnet.

20. The system of claim 11, wherein the first surface of the spacer is adapted for mounting to a butt plate of a firearm.

* * * * *